United States Patent [19]

Iwasaki

[11] 4,145,585

[45] Mar. 20, 1979

[54] ROTARY PULSE SWITCH

[75] Inventor: Sadayoshi Iwasaki, Furukawa, Japan

[73] Assignee: Alps Electric Co., Ltd., Japan

[21] Appl. No.: 827,346

[22] Filed: Aug. 24, 1977

[30] Foreign Application Priority Data

Aug. 24, 1976 [JP] Japan ..... 51-100813

[51] Int. Cl.[2] ..... H01H 19/54

[52] U.S. Cl. ..... 200/11 DA; 200/11 G; 200/153 M

[58] Field of Search ..... 200/1 B, 11 R, 11 DA, 200/11 G, 11 J, 11 TW, 17, 18, 153 L, 153 LB, 153 M, 61.19, 241, 242, 253, 292

[56] References Cited

U.S. PATENT DOCUMENTS

| | | | |
|---|---|---|---|
| 2,172,396 | 9/1939 | Meuer | 200/153 L X |
| 3,030,460 | 4/1962 | Huetten et al. | 200/11 DA |
| 3,239,629 | 3/1966 | Lesser | 200/153 M X |
| 3,736,390 | 5/1973 | Lockard | 200/11 DA |
| 3,959,756 | 5/1976 | Deming | 200/61.19 X |

FOREIGN PATENT DOCUMENTS

| | | | |
|---|---|---|---|
| 1170495 | 5/1964 | Fed. Rep. of Germany | 200/11 DA |

OTHER PUBLICATIONS

AMP, Inc., "Switches and Relays," Data Sheet Number 76-408; Aug. 1976.

*Primary Examiner*—James R. Scott
*Attorney, Agent, or Firm*—Guy W. Shoup; Gerard F. Dunne

[57] ABSTRACT

A rotary pulse switch wherein either one of two circuits can be selected depending on the direction of rotation of a turn shaft, and the selected circuit can be turned on and off consecutively. The switch includes a rotor having a conductor portion comprised of a ring-shaped common portion and a plurality of radially extending rotary contact portions. An insulating shutter plate is disposed between the rotor and contacts engageable therewith. The contacts include two adapted to engage the rotary contact portions and a single contact adapted to engage the common portion. Rotation of the shutter plate in either direction will electrically isolate one of the two contacts while electrically connecting the other of the two with the rotary contact portions.

2 Claims, 11 Drawing Figures

ROTARY PULSE SWITCH

BACKGROUND OF THE INVENTION

The present invention relates to a rotary pulse switch used for a transceiver and the like, and more particularly, to such a switch wherein either one of two circuits can be selected depending on the direction of rotation of a turn shaft, and the selected circuit can be turned on and off consecutively.

An object of the present invention is to provide such a rotary pulse switch which is simple in its construction and excellent in its electrical performance.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENTS

Figure 1:
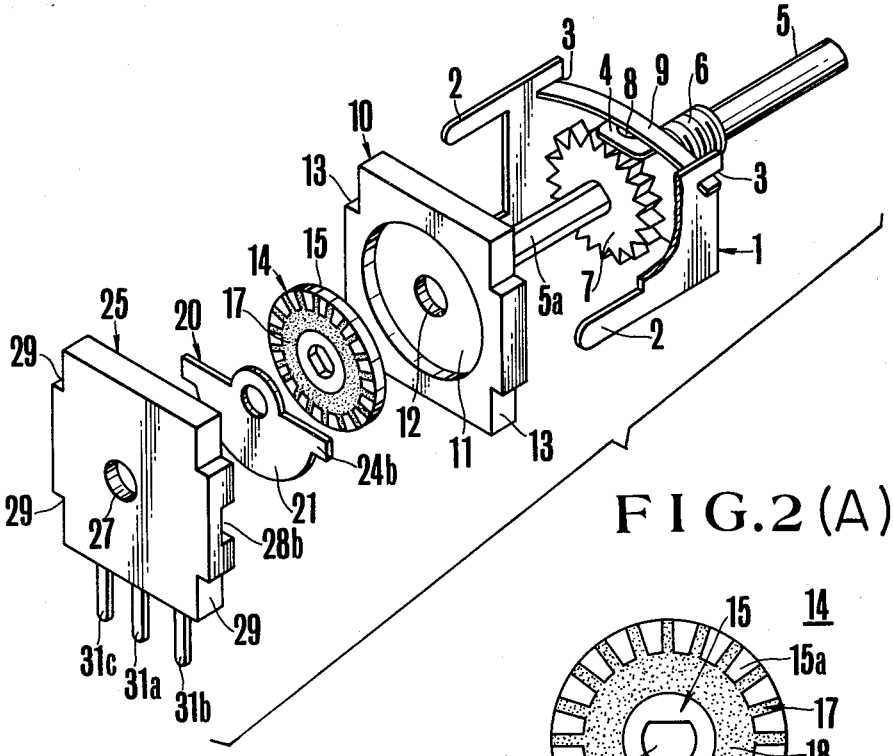
FIG. 1 is an exploded perspective view, partially broken away, of one embodiment of a rotary pulse switch in accordance with the present invention.
Figure 2A:
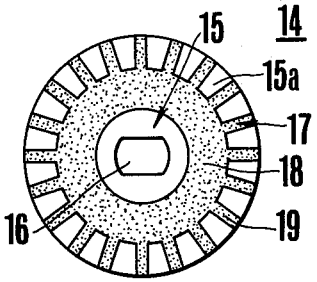
FIG. 2*a* is a plan view of the rotor 14 used in FIG. 1.
Figure 3:
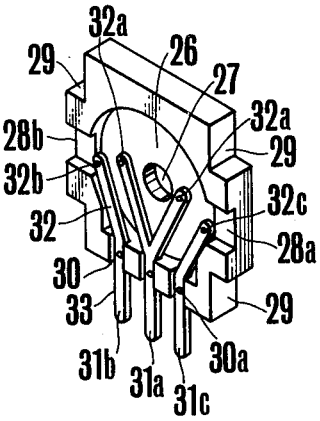
FIG. 3 is a perspective view showing the inside of the case 25.
Figure 2B:
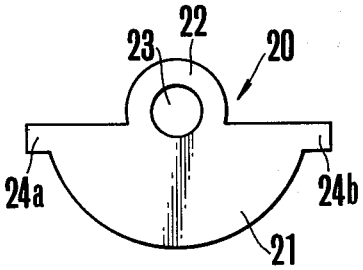
FIG. 2*b* is a plan view of the insulating plate 20 used in FIG. 1.
Figure 4:
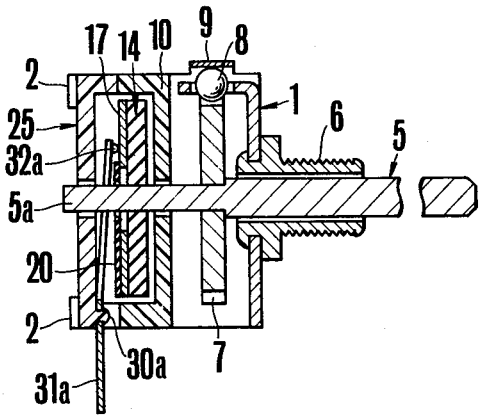
FIG. 4 is a cross-sectional side view of the switch when assembled.

FIGS. 1–4 show, in various aspects, one embodiment of a rotary pulse switch in accordance with the present invention. A frame 1 formed from a metallic plate or the like has four arms, only two of which are shown at 2,2, extending rearwardly from its side panels. The frame 1 also includes notches 3,3 formed at the upper and front part of the side panels and a support 4 formed by bending back a tab portion of the upper side of the front panel and used to guide a steel ball 8. A shaft 5 having an outer handle portion is rotatably installed in the frame 1 by means of a bearing 6 attached to the front panel of the frame, and includes an inner shaft portion 5*a* extending inside the frame 1. The shaft portion 5*a* is provided with flat and parallel planes on two sides and has a cross-section generally similar to an oval. A cam wheel 7 is used as a stepping mechanism, and is fixed in position by iserting the shaft portion 5*a* into a shaft hole (not shown) located in the center of the cam wheel 7. The stepping mechanism is constructed in such manner that the steel ball 8 is accommodated movably in a hole (not shown) in the support 4 of the frame 1 and is pressed downward by means of a leaf spring 9 to maintain engagement between the ball 8 and the cam wheel 7. The leaf spring 9 is supported by means of the notches 3,3 on the frame 1.

A case 10 which may be made of synthetic resin, is provided with a circular recessed portion 11 used for accomodating a rotor 14, a circular shaft hole 12 centered in the base of the recessed portion 11 for receiving the shaft portion 5*a*, and four shoulders 13 at its corners.

The diameter of the recessed portion 11 is made slightly larger than that of the rotor 14 and the depth of the recessed portion is almost equal to the thickness of the rotor 14. The rotor 14 is made from an insulating disc 15 laminated on one surface with copper or other conductive material and provided at its center with a nearly oval-like shaft hole 16 used for receiving the shaft portion 5*a*. The laminated copper forms a conductor portion 17 and is formed acording to the same method as copper foil is treated for producing a printed circuit board.

The conductor portion 17 forms a ring-shaped common conductor portion 18 and a plurality (even number) of rotary contact portions 19 extending radially from the periphery of the common conductor portion 18 and spaced apart at an equal angle so as to form an insulation part 15*a* between adjacent rotary contact portions 19. In addition, the rotary contact portions 19 are so arranged that they are positioned symmetrically with respect to the center of the shaft hole 16. The inside diameter of the common conductor portion 18 is slightly larger than the diameter of the shaft hole 16, and the number of rotary contact portions 19 is equal to the number of teeth or camming surfaces of the cam wheel 7 of the stepping mechanism. Alternatively, the rotor 14 may be formed by adhering a conductor portion 17 made from a thin metal sheet separately on the insulating disc 15.

An insulating plate 20 made of a sheet of synthetic resin or the like includes a semicircular shutter portion 21, a circular shaft hole 23 formed in a ring portion 22 disposed at the middle of its upper edge, and stoppers 24*a* and 24*b* formed by extending corner portions of the plate outward. The diameter of the shaft hole 23 is almost equal to the largest diameter of the shaft portion 5*a*, which corresponds to the diameter of the handling shaft 5.

An end case 25 made of synthetic resin includes a recessed portion 26 (FIG. 3) having a diameter equal to that of the recessed portion 11 of the case 10 and a circular shaft hole 27 located at its center for rotatably receiving the shaft portion 5*a*. The end case 25 further includes a pair of grooves 28*a* and 28*b* used for restricting the angle of rotation of the insulating plate 20, four shoulders 29 at its corners, and three grooves 30 disposed in its lower side for receiving fixed contact elements 31*a*, 31*b* and 31*c*. Each of the fixed contact elements 31*a*, 31*b* and 31*c* is made from a thin metal sheet with sufficient resiliency, and consists of a terminal portion 33 and a finger portion 32. The fixed contact element 31*a* has two fingers 32, so that it is formed like a Y. Contact chips 32*a*, 32*b* and 32*c* are provided on the tips of the respective fingers 32. In addition, each of the fixed contact elements 31*a*, 31*b* and 31*c* is provided with a hole (not shown) in the terminal portion 33 and set in place by utilizing the hole and a boss 30*a* formed within the groove 30 of the case 25, and fixed there by calking the boss 30*a* against the hole.

The assembling of the rotary switch will now be explained in detail. After mounting the shaft 5 as well as the stepping mechanism in position on the frame 1, the case 10, rotor 14, insulating plate 20 and end case 25 are set in that order in the shaft portion 5*a* of the shaft 5 by way of the shaft holes 12, 16, 23 and 27. At this juncture, the shoulders 13 and 29 of the cases 10 and 25, respectively, are aligned with respect to the arms 2 of the frame 1. Lastly, the forward ends of the arms 2 are bent at the rear panel of the end case 25 to fix all the parts to the frame 1. During this assembling, the cases 10 and 25 must be so arranged that the respective recessed portions 11 and 26 face each other, and the rotor 14 must be housed in the recessed portion 11 of the case 10 so that the conductor portion 17 on the rotor 14 faces the fixed contact elements 31*a*, 31*b* and 31*c* attached to the end case 25. In addition, the insulating plate 20 must be so arranged that the stoppers 24*a* and 24*b* are positioned within the grooves 28*a* and 28*b* of the end case 25 and rotatably mounted on the shaft portion 5*a* in close contact with the conductor portion 17 of the rotor 14.

Figure 5A:
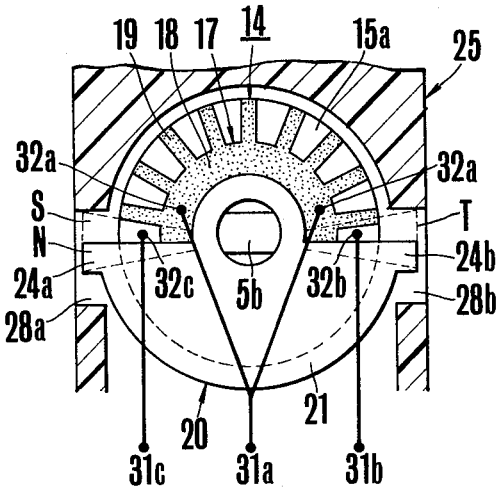
FIGS. 5*a*, 5*b* and 5*c* are schematic diagrams used for explaining the operation of the switch.

The operation of the switch will be explained by reference to FIGS. 5*a*, 5*b* and 5*c*. When the switch is not operated, it can be seen from FIG. 5*a* that the lower part of the conductor portion 17 of the rotor 14 is in contact with the shutter portion 21 of the insulating plate 20, the contacts 32*a*, 32*a* of the fixed contact element 31*a* are in contact with the common conductor portion 18 of the rotor 14, and the contacts 32*b* and 32*c* of the fixed contact elements 31*b* and 31*c* are located symmetrically with respect to the center of the shaft portion 5*a*. When the shutter portion 21 of the insulating plate 20 is turned and held at the position N indicated by the full line as illustrated in FIG. 5*a*, the contacts 32*b* and 32*c* are in contact with the insulation parts 15*a*, 15*a*. When the shutter portion 21 is rotated in either clockwise or counter-clockwise direction and thus located at either of the positions S or T as indicated by the dotted line in FIG. 5*a*, one of the contacts 32*b* or 32*c* is blocked so as not to contact the rotor 14, and the other is on the insulation part 15*a* of the rotor 14. Therefore, in either case, the fixed contact elements 31*a*, 31*b* and 31*c* are electrically blocked from each other and the switch is under the "OFF"condition.

Assume now that the shutter portion 21 is in the position N or T. If the rotor 14 is turned clockwise, in the drawing, by means of the handle portion of the shaft 5, the insulating plate 20 is rotated together with the rotor 14 (the insulating plate 20 revolves together with the rotor 14 due to the friction between the shaft portion 5*a* and the shaft hole 23 or the viscosity resulted from grease applied to the conductor portion 17) until the stopper 24*a* abuts on the upper inside wall of the groove 28*a* of the end case 25. This condition is illustrated in FIG. 5*b*. In FIG. 5*b*, any electrical connection between the contact 32*c* and the rotor 14 is blocked by the shutter portion 21. On the other hand, the contact 32*b* is in contact with a rotary contact portion 19 due to the rotation of the rotor 14 while the shutter portion 21 is removed from the position of the contact 32*b*. As a result, electrical connection between the fixed contact pieces 31*a* and 31*b* is established through the conductor portion 17. When the rotor 14 is further rotated while the insulating plate 20 slides on the shaft 5, contact 32*b* is disengaged from the rotary contact portion 19 and comes into contact with the next insulation part 15*a*, one step being instantly advanced by means of the stepping mechanism, and the switch returns to the "OFF" state. Under this state, the insulating plate 20 is located at the position illustrated in FIG. 5*b* (In FIG. 5*a*, it corresponds to the position S). It can thus be seen that the contacts 32*a*, 32*a* are always in contact with the common conductor portion 18 regardless of the rotation of the insulating plate 20. If the rotor 14 is further rotated in the same direction, the contact 32*b* is alternately engaged and disengaged from the rotary contact portions 19 every time the stepping mechanism advances one step, and the on-off operation is therefore repeated between the fixed contact elements 31*a* and 31*b* only.

Next, when the rotor 14 is rotated in the counter-clockwise direction in the drawing, the insulating plate 20 is turned in the reverse direction as compared with the previous operation until the stopper 24*b* abuts on the upper inside wall of the groove 28*b* of the end case 25. At this stage, the electrical connection between the contact 32*b* and the rotor 14 is blocked by the shutter portion 21, and the contact 32*c* comes into contact with and is disengaged from the rotary contact portions 19 every time the switch advances through one step due to similar operation as mentioned above. As the result, the on-off operation is repeated between the fixed contact elements 31*a* and 31*c* only.

In other words, the rotary switch according to the present invention may be made to energize either one of two circuits depending on the direction of rotation of the rotor 14. Therefore, the switch can be used to select a station for a transceiver or the like by combining it with a pulse generation circuit since the selected circuit is turned on and off consecutively.

Figure 5B:
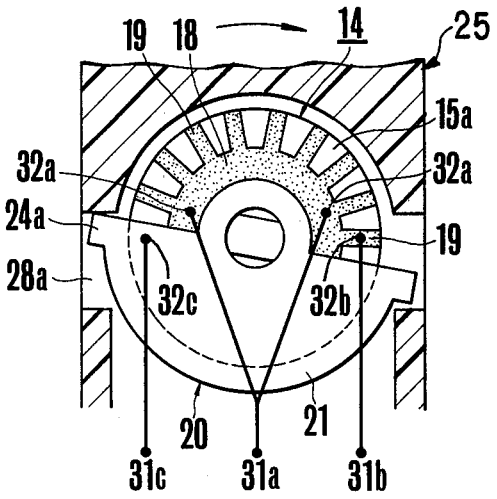
Figure 5C:
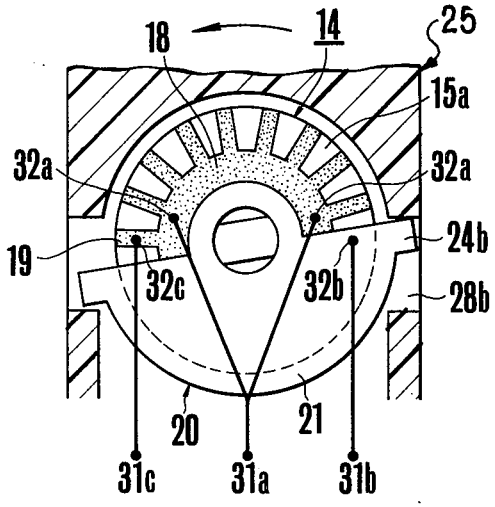

After the switch is once operated, the insulating plate 20 will be held at either position illustrated in FIG. 5*b* or 5*c*, due to its frictional engagement with the shaft portion 5*a*, provided that the rotor 14 is at a standstill.

In spite of the simplicity in its construction, the rotary pulse switch according to this invention can operate as described above and is highly reliable in its electrical performance because the contact portions are of self-cleaning type. In addition, as compared with a device of leaf switch type, the generation of chattering is extremely less and smooth operation is assured in view of the structure of the contact portions. Consequently, the electrical performance as rotary pulse switch and its productivity are greatly improved.

Figure 6A:
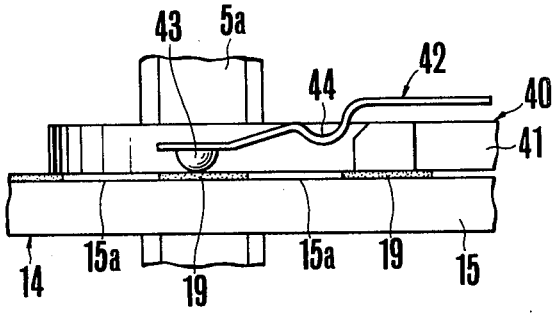
FIGS. 6*a* and 6*b* are side views of a main portion of another embodiment according to the present invention.
Figure 6B:
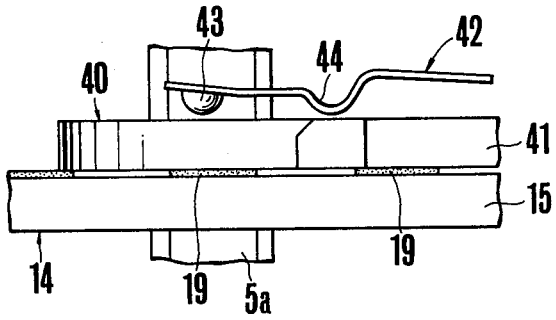
Figure 6C:
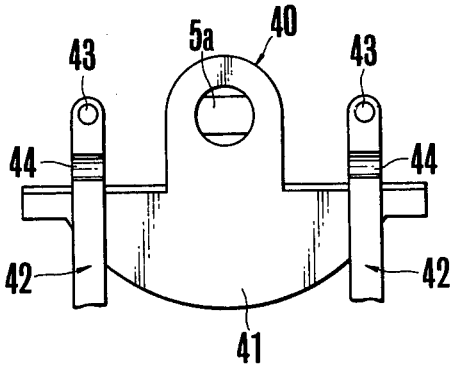
FIG. 6*c* is a plan view of a main portion of FIG. 6*a*.

Referring to FIG. 6 which shows another embodiment of the present invention, an insulating plate 40 is so constructed that its shutter portion 41 is made smaller in area and larger in its thickness than that of the shutter portion of the insulating plate 20 of the first embodiment. The fixed contact elements 42 are provided with contacts 43 at the tips thereof as well as curved portions 44 at the middle portions thereof, and establish an electrical path through the rotary contact 19 on the rotor 14. When the insulating plate 40 is rotated, a respective curved portion 44 is pushed upward by means of the shutter portion 41 to bend the respective fixed contact element 42 and disengage the contact 43 from the surface of the rotor 14.

In all cases, it is understood that the above-described embodiments are merely illustrative of but a small number of the many specific embodiments which can represent application of the principle of the present invention. Numberous modification can be readily made by those skilled in the art without departing from the spirit and scope of the invention.

What is claimed is:

1. A rotary switch comprising:

a case;

a turn shaft mounted within said case;

an insulating disc fixed centrally to said shaft and having a conductor portion on one surface thereof;

said conductor portion comprising a ring-shaped common portion and a plurality of rotary contact portions extending radially from said common portion and spaced equally apart;

a pair of fixed contact elements disposed symmetrically about said turn shaft and each having a contact portion slidably engageable with said rotary contact portions;

another fixed contact element having a contact portion slidably engaging said common portion;

an insulating plate interposed between the conductor portion on said disc and said contact elements;

said plate being mounted normally for rotation with said shaft yet slidable thereon and having stopper portions extending outwardly from opposite locations on said plate and adapted to abut portions of said case so as to limit rotation of said plate through a limited arc;

whereby upon the rotation of said shaft in either direction, one of the contact portions of said pair of fixed contact elements will be electrically isolated from said rotary contact portion while the other contact portion of said pair will contact said rotary contact portion as said rotary contact portions are rotated past said other contact portion.

2. A rotary switch according to claim 1, further comprising a means by which said shaft can be turned through discrete steps.

* * * * *